US010182698B2

(12) United States Patent
Steiner

(10) Patent No.: US 10,182,698 B2
(45) Date of Patent: Jan. 22, 2019

(54) DISHWASHER

(71) Applicant: ELECTROLUX APPLIANCES AKTIEBOLAG, Stockholm (SE)

(72) Inventor: Winfried Steiner, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 265 days.

(21) Appl. No.: 15/032,487

(22) PCT Filed: Nov. 29, 2013

(86) PCT No.: PCT/EP2013/075090
§ 371 (c)(1),
(2) Date: Apr. 27, 2016

(87) PCT Pub. No.: WO2015/078514
PCT Pub. Date: Jun. 4, 2015

(65) Prior Publication Data

US 2016/0270627 A1 Sep. 22, 2016

(51) Int. Cl.
*A47L 15/00* (2006.01)
*A47L 15/42* (2006.01)

(52) U.S. Cl.
CPC ..... *A47L 15/0047* (2013.01); *A47L 15/428* (2013.01); *A47L 15/4223* (2013.01);
(Continued)

(58) Field of Classification Search
CPC ..... A47L 15/4291; A47L 15/0047; A47L 15/4251; A47L 15/4225; A47L 15/4223;
(Continued)

(56) References Cited

U.S. PATENT DOCUMENTS 8,157,923 B1 * 4/2012 Mohrbacher, Jr. ..... A47L 15/0031 134/10
2011/0114133 A1 * 5/2011 Rosenbauer ..... A47L 15/0013 134/25.2

(Continued)

FOREIGN PATENT DOCUMENTS

CN 103269632 8/2013
DE 10 2011 08785 6/2013

(Continued)

OTHER PUBLICATIONS

Machine Translation of EP 2327349 A1 to Serve, Jun. 2011.*

(Continued)

*Primary Examiner* — Michael E Barr
*Assistant Examiner* — Benjamin L Osterhut
(74) *Attorney, Agent, or Firm* — Alston & Bird LLP

(57) ABSTRACT

A dishwasher is provided including a washing chamber with a sump and a hydraulic arrangement. The hydraulic arrangement may include the sump, a circulation pump, one or more spray arrangements, and a washing liquid storage tank. The circulation pump may include an inlet and a first outlet, the inlet being connected to the sump and the first outlet being connected to the one or more spray arrangements, wherein the circulation pump may be arranged to pump washing liquid from the sump to the one or more spray arrangements via the first outlet. The circulation pump may include a second outlet connected to the washing liquid storage tank wherein the circulation pump may be further arranged to pump washing liquid from the sump to the washing liquid storage tank via the second outlet.

8 Claims, 1 Drawing Sheet

(52) U.S. Cl.
CPC ..... *A47L 15/4225* (2013.01); *A47L 15/4251* (2013.01); *A47L 15/4291* (2013.01); *A47L 15/4219* (2013.01); *A47L 15/4221* (2013.01); *A47L 2501/03* (2013.01); *A47L 2501/05* (2013.01); *A47L 2501/10* (2013.01); *A47L 2501/20* (2013.01)

(58) Field of Classification Search
CPC ..... A47L 15/428; A47L 15/4219; A47L 15/4221; A47L 2501/10; A47L 2501/05; A47L 2501/03; A47L 2501/20
See application file for complete search history.

(56) References Cited

U.S. PATENT DOCUMENTS

| | | | | |
|---|---|---|---|---|
| 2011/0114140 | A1* | 5/2011 | Heisele | A47L 15/0015 134/56 D |
| 2011/0232690 | A1* | 9/2011 | Ericsson | A47L 15/0081 134/25.2 |
| 2012/0137447 | A1* | 6/2012 | Aykroyd | D06F 35/005 8/137 |
| 2012/0145193 | A1* | 6/2012 | Buser | A47L 15/0057 134/10 |
| 2012/0145194 | A1 | 6/2012 | Jerg et al. | |
| 2012/0145195 | A1* | 6/2012 | Buser | A47L 15/0057 134/18 |
| 2012/0145200 | A1* | 6/2012 | Jerg | A47L 15/0015 134/25.2 |
| 2013/0000673 | A1* | 1/2013 | Delgado | A47L 15/0047 134/10 |
| 2014/0060579 | A1* | 3/2014 | Slabbekoorn | A47L 15/0021 134/10 |
| 2014/0060590 | A1* | 3/2014 | Aras | A47L 15/4206 134/111 |
| 2014/0069465 | A1* | 3/2014 | Slabbekoorn | A47L 15/0028 134/25.2 |
| 2014/0224285 | A1* | 8/2014 | Ham | A47L 15/0047 134/184 |
| 2014/0366916 | A1* | 12/2014 | Lundberg | A47L 15/4291 134/18 |

FOREIGN PATENT DOCUMENTS

| | | | |
|---|---|---|---|
| EP | 0669097 | 8/1995 | |
| EP | 2327349 A1 * | 6/2011 | A47L 5/0057 |
| EP | 2 570 069 | 3/2013 | |
| EP | 2 583 614 | 4/2013 | |

OTHER PUBLICATIONS

Machine Translation of EP 2570069 A1 to Hellweg et al., Mar. 2013.*

International Search Report for corresponding International Application No. PCT/EP2013/075090, dated Feb. 10, 2014.

Office Action for Chinese Application No. 201380080774.3 dated Mar. 9, 2018, 7 pages.

* cited by examiner

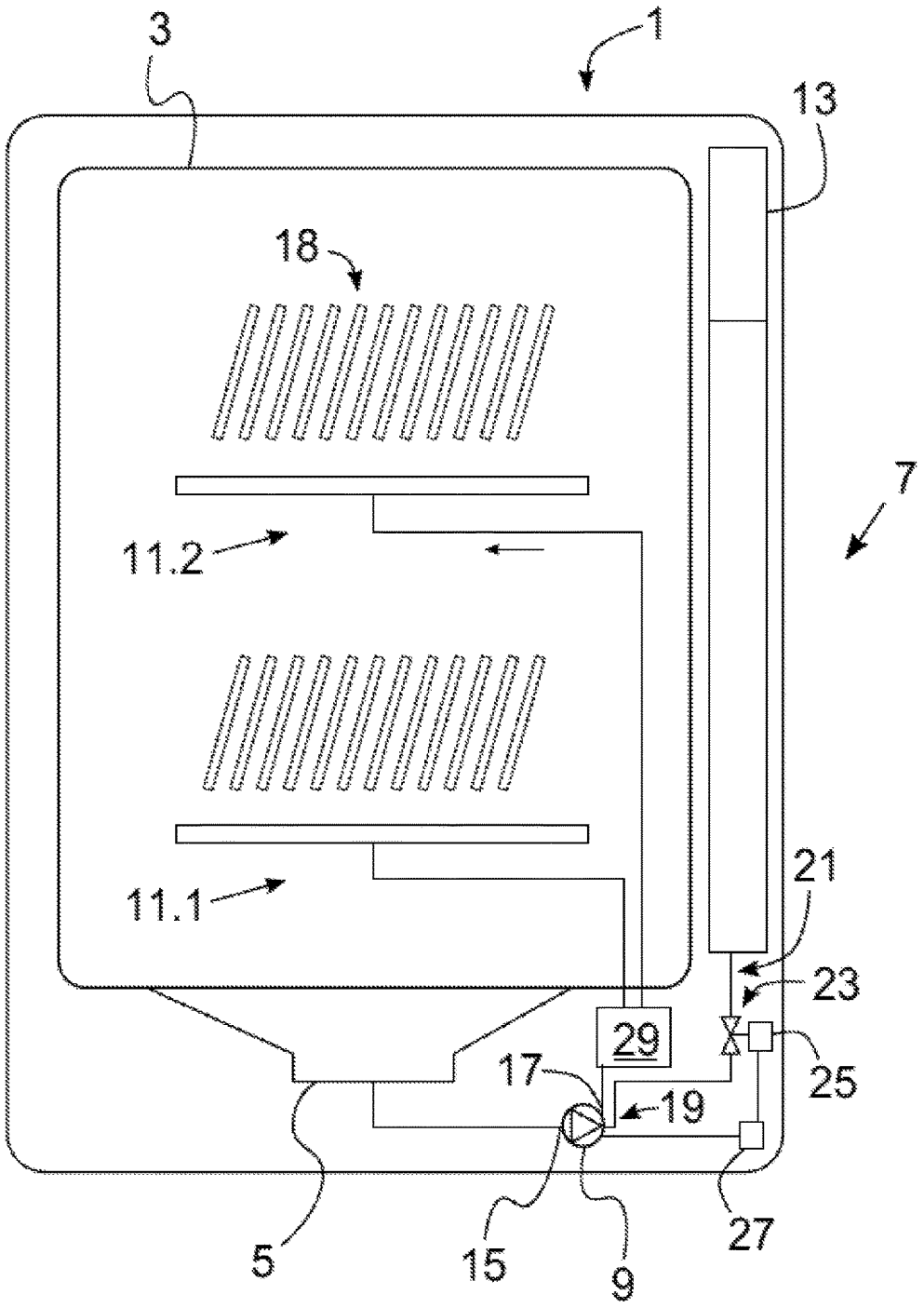
3
1
13
18
7
11.2
11.1
21
23
29
25
17
19
5
15
9
27

DISHWASHER

CROSS-REFERENCE TO RELATED APPLICATIONS

This application is a national stage application filed under 35 U.S.C. § 371 of International Application No. PCT/EP2013/075090 filed Nov. 29, 2013, which application is hereby incorporated by reference in its entirety.

TECHNICAL FIELD

The present invention relates to a dishwasher.

BACKGROUND

Today's dishwashers are expected to perform high quality wash of dishes. In addition, environmental concerns require an efficient use of water and energy during a wash session. The requirement of performing high quality wash of dishes and the requirement of efficient use of water and energy during a wash session can be seen as two conflicting requirements. In order to reduce the amount of washing liquid and energy required during a wash session without compromising the quality of the washing process, it has been suggested to use a washing liquid storage tank arranged to store washing liquid for subsequent re-use. Such a washing liquid storage tank can be arranged to store washing liquid for re-use in a later stage of a wash cycle or for re-use in a subsequent wash cycle. The use of a washing liquid storage tank is described in the document EP 2583614 A2. However, a washing liquid storage tank, and the arrangement needed for the purpose of filling and emptying such a tank may add a considerable amount of production cost to a dishwasher. The filling and emptying of such a tank require hydraulic components as well as control functions. In the light of the above, there is a need for a dishwasher allowing an efficient use of washing liquid and being simple and cost efficient to manufacture.

SUMMARY

An object of the present invention is to provide a dishwasher allowing an efficient use of washing liquid and being simple and cost efficient to manufacture.

According to an aspect of the invention, the object is achieved by a dishwasher comprising a washing chamber with a sump and a hydraulic arrangement comprising the sump, a circulation pump, one or more spray arrangements, and a washing liquid storage tank, wherein the circulation pump comprises an inlet and a first outlet, the inlet being connected to the sump and the first outlet being connected to the one or more spray arrangements, wherein the circulation pump is arranged to pump washing liquid from the sump to the one or more spray arrangements via the first outlet, wherein the one or more spray arrangements are arranged to spray washing liquid into the washing chamber, wherein the circulation pump is provided with a second outlet connected to the washing liquid storage tank wherein the circulation pump is further arranged to pump washing liquid from the sump to the washing liquid storage tank via the second outlet.

Since the dishwasher comprises a hydraulic arrangement comprising a washing liquid storage tank and since the circulation pump is arranged to pump washing liquid from the sump to the washing liquid storage tank via the second outlet, a dishwasher is provided allowing an efficient use of washing liquid. Also, since the circulation pump is arranged to pump washing liquid from the sump to the washing liquid storage tank via the second outlet, a simple and cost efficient solution of filling the washing liquid storage tank is provided since the need of additional components such as a flow controller, T-junctions, or other hydraulic components is reduced. Thereby, the hydraulic arrangement is simple and cost efficient to manufacture and thus also the dishwasher comprising the hydraulic arrangement.

As a result, the above mentioned object is achieved.

Also, due to the second outlet, a length of conduits of the hydraulic arrangement may be reduced.

According to some embodiments, the hydraulic arrangement further comprises a first conduit wherein the second outlet is connected to the washing liquid storage tank via the first conduit wherein said first conduit is provided with a flow regulating valve having at least an open state and a closed state. Since the first conduit is provided with a flow regulating valve having at least an open state and a closed state, an easy control of a filling and/or emptying of the washing liquid storage tank can be performed. Also, such control can be performed by using components which are simple and cost efficient to manufacture as compared to previous solutions, for example solutions where a pump provided with a single outlet is used together with a flow controller comprising an inlet and several outlets.

According to some embodiments, washing liquid in the washing liquid storage tank is arranged to be evacuated from the washing liquid storage tank to the sump via the circulation pump in a direction from the second outlet to the inlet of the circulation pump, when a motion of the circulation pump is stopped and the flow regulating valve is in the open state. Thereby, the emptying of the washing liquid storage tank can be performed in an easy manner without the need of additional components.

According to some embodiments, the washing liquid storage tank is arranged at a position such that washing liquid stored in the washing liquid storage tank is stored at a higher location than washing liquid in the sump, and where washing liquid in the washing liquid storage tank is arranged to be evacuated from the washing liquid storage tank to the sump by the force of gravity. Thereby, the emptying of the washing liquid storage tank can be performed in an easy manner without the need of additional components. As a result, a dishwasher is provided comprising a hydraulic arrangement capable of storing and re-using washing liquid and where the hydraulic arrangement of the dishwasher is simple and cost efficient to manufacture.

According to some embodiments, the hydraulic arrangement further comprises an actuator arranged to control the flow regulating valve between the open state and the closed state. In such embodiments, since the hydraulic arrangement further comprises an actuator arranged to control the flow regulating valve between the open state and the closed state, an easy control of a filling and/or emptying of the washing liquid storage tank can be performed.

According to some embodiments, the washing liquid storage tank is arranged to store washing liquid for subsequent use. In such embodiments, since the washing liquid storage tank is arranged to store washing liquid for subsequent use, a dishwasher is provided where the use of clean water and energy can be reduced.

Further features of, and advantages with, the present invention will become apparent when studying the appended claims and the following detailed description. Those skilled in the art will realize that the different features described may be combined to create embodiments other than those described in the following, without departing from the scope of the present invention, as defined by the appended claims.

BRIEF DESCRIPTION OF THE DRAWINGS

The various aspects of the invention, including its particular features and advantages, will be readily understood from the following detailed description and the accompanying drawings, in which:

The FIGURE illustrates a dishwasher 1 comprising a washing chamber 3 with a sump 5 and a hydraulic arrangement 7.

DETAILED DESCRIPTION

The embodiments herein will now be described more fully with reference to the accompanying drawings, in which example embodiments are shown. Disclosed features of example embodiments may be combined as readily understood by one of ordinary skill in the art. Like numbers refer to like elements throughout.

Well-known functions or constructions will not necessarily be described in detail for brevity and/or clarity.

The FIGURE illustrates a dishwasher 1 comprising a washing chamber 3 with a sump 5 and a hydraulic arrangement 7. The hydraulic arrangement 7 comprises the sump 5, a circulation pump 9, one or more spray arrangements 11.1, 11.2, and a washing liquid storage tank 13. The circulation pump 9 comprises an inlet 15 and a first outlet 17. The inlet 15 is connected to the sump 5 and the first outlet 17 is connected to the one or more spray arrangements 11.1, 11.2. The circulation pump 9 is arranged to pump washing liquid from the sump 5 to the one or more spray arrangements 11.1, 11.2 via the first outlet 17. The one or more spray arrangements 11.1, 11.2 are arranged to spray washing liquid into the washing chamber 3 onto dishes 18 placed in the washing chamber 3. The hydraulic arrangement 7 may comprise two spray arrangements 11.1, 11.2, a lower spray arrangement 11.1 and an upper spray arrangement 11.2. The one or more spray arrangements 11.1, 11.2 may comprise spray arms provided with nozzles where the spray arms may be arranged to rotate by a reaction force of washing liquid being sprayed out of the nozzles into the washing chamber 3. The washing liquid may comprise water, or a mixture of water, detergent and/or softener. When the washing liquid has been sprayed into the washing chamber 3 onto dish 18 placed in the washing chamber 3 the washing liquid is arranged to be collected in the sump 5. The circulation pump 9 is arranged to pump washing liquid from the sump 5 to the one or more spray arrangements 11.1, 11.2 via the first outlet 17 of the circulation pump 9.

Also, the circulation pump 9 is provided with a second outlet 19 where the second outlet 19 is connected to the washing liquid storage tank 13 wherein the circulation pump 9 is further arranged to pump washing liquid from the sump 5 to the washing liquid storage tank 13 via the second outlet 19. Thereby, the washing liquid storage tank 13 can be filled in an easy manner.

The hydraulic arrangement 7 is further arranged to be connected to water mains and a drain. The hydraulic arrangement 7 may be arranged to be connected to water mains and a drain via connections (not shown) in the sump 5.

The circulation pump 9 may be of radial flow type such as a centrifugal pump or may be of axial flow or half axial flow type. The circulation pump 9 is driven by an electric motor (not shown).

The hydraulic arrangement 7 may further comprise a first conduit 21 wherein the second outlet 19 of the circulation pump 9 is connected to the washing liquid storage tank 13 via the first conduit 21 and where said first conduit 21 is provided with a flow regulating valve 23 having at least an open state and a closed state. The hydraulic arrangement 7 may further comprise an actuator 25 arranged to control the flow regulating valve 23 between the open state and the closed state. The flow regulating valve 23 may be of ball-, globe- or butterfly-type valve and the actuator 25 may be a solenoid, a bi-metal actuator, or an electric motor, or an electrothermic actuator such as a wax motor.

The first conduit 21, as well as other connections in the hydraulic arrangement 7, may comprise one or more flexible hoses.

The washing liquid storage tank 13 may be arranged adjacent to the washing chamber 3 at a position such that washing liquid being stored in the washing liquid storage tank 13 is stored at a higher location than washing liquid in the sump 5. In embodiments wherein the washing liquid storage tank 13 is arranged at a position such that washing liquid being stored in the washing liquid storage tank 13 is stored at a higher location than washing liquid in the sump 5, washing liquid in the washing liquid storage tank 13 is arranged to be evacuated from the washing liquid storage tank 13 to the sump 5 via the circulation pump 9 by the force of gravity.

The dishwasher 1 may further comprise a control unit 27 arranged to control the actuator 25 and a rotational speed of the electric motor driving the circulation pump 9.

When the washing liquid storage tank 13 is to be filled with washing liquid, the control unit 27 may be arranged to control the actuator 25 such that the flow regulating valve 23 assumes the open state and a rotational speed of the electric motor is such that the circulation pump 9 is able to pump washing liquid through the second outlet 19 via the first conduit 21 and the flow regulating valve 23 to the washing liquid storage tank 13. When the washing liquid storage tank 13 is filled to a certain level, the control unit 27 may control the actuator 25 such that the flow regulating valve 23 assumes the closed state. Thereby, washing liquid can be stored in the washing liquid storage tank 13 for subsequent use even when/if a motion of the circulation pump is stopped.

The washing liquid storage tank 13 may comprise a venting passage or a venting valve (not shown) in an upper region of the washing liquid storage tank 13 in order to admit passage of air while filling or emptying the washing liquid storage tank 13.

The hydraulic arrangement 7 may comprise a flow control device 29 arranged in a connection between the first outlet 17 of the circulation pump 9 and the one or more spray arrangements 11.1, 11.2. The flow control device 29 may be arranged to control a flow of washing liquid to the one or more spray arrangements 11.1, 11.2.

When the washing liquid storage tank 13 is to be filled with washing liquid, the flow control device 29 may be arranged to close a connection between the first outlet 17 of the circulation pump 9 and a lower spray arrangement 11.1. Thereby, a flow resistance in the conduit arranged between the first outlet 17 and the one or more spray arrangements may be increased. As a result, filling of the washing liquid storage tank 13 with washing liquid can be performed with a reduced rotational speed of the circulation pump 9 as compared to when running the circulation pump with an open connection between the first outlet 17 of the circulation pump 9 and the lower spray arrangement 11.1. Closing the connection between the first outlet 17 and the lower spray arrangement 11.1 may also serve to speed up the process of filling the washing liquid storage tank 13. In embodiments where the hydraulic arrangement 7 comprises two spray arrangements 11.1, 11.2, in the form of an upper spray arrangement 11.2 and a lower spray arrangement 11.1, the washing liquid storage tank 13 may be arranged to be filled to a level corresponding to a height of the upper spray arrangement 11.2. Further, according to some embodiments, the flow resistance of nozzles of the upper spray arrangement 11.2 and/or the lower spray arrangement 11.1 may be used to be able to fill the washing liquid storage tank 13 with washing liquid to a level exceeding the height of the upper spray arrangement 11.2. Such a level in the washing liquid storage tank 13 is illustrated in the FIGURE.

According to some embodiments, washing liquid in the washing liquid storage tank 13 is arranged to be evacuated from the washing liquid storage tank 13 to the sump 5 via the circulation pump 9 in a direction from the second outlet 19 to the inlet 15 of the circulation pump 9, when a motion of the circulation pump 9 is stopped and the flow regulating valve 23 is in the open state.

Thereby, the washing liquid in the washing liquid storage tank 13 can be re-used in an easy manner. The washing liquid in the washing liquid storage tank 13 can be re-used in a later stage of a wash cycle or re-used in a subsequent wash cycle.

Accordingly, according to some embodiments, when the washing liquid storage tank 13 is to be emptied and washing liquid stored in the washing liquid storage tank 13 is to be transferred to the sump for subsequent use for washing or rinse, the control unit 27 may be arranged to control the actuator 25 such that the flow regulating valve 23 assumes the open state and a rotational speed of the electric motor is stopped such that a motion of the circulation pump 9 is stopped. Thereby, the washing liquid is able to flow from the washing liquid storage tank 13 to the sump 5 via the first conduit 21, the flow regulating valve 23 and the circulation pump 9.

When the washing liquid storage tank 13 has been emptied, or emptied to a desired level, the control unit 27 may control the actuator 25 such that the flow regulating valve 23 assumes the closed state. Thereby, the washing liquid in the washing liquid storage tank 13 can be re-used in an easy manner and filling of the washing liquid storage tank 13 with washing liquid is circumvented when the motion of the circulation pump is started.

It is to be understood that the foregoing is illustrative of various example embodiments and the invention is not to be limited to the specific embodiments disclosed and that modifications to the disclosed embodiments, combinations of features of disclosed embodiments as well as other embodiments are intended to be included within the scope of the appended claims.

The invention claimed is:

1. A dishwasher comprising a washing chamber with a sump and a hydraulic arrangement comprising;

the sump, a circulation pump, first and second spray arrangements, and a washing liquid storage tank, wherein the circulation pump comprises an inlet and a first outlet, the inlet being connected to the sump and the first outlet being connected to the first and second spray arrangements, wherein the circulation pump is arranged to pump washing liquid from the sump to the first and second spray arrangements via the first outlet through a flow control device, wherein the flow control device is configured to control flow between the first outlet and the first and second spray arrangements, wherein the first and second spray arrangements are arranged to spray washing liquid into the washing chamber, wherein the circulation pump is provided with a second outlet connected to the washing liquid storage tank wherein the circulation pump is further arranged to pump washing liquid from the sump to the washing liquid storage tank via the second outlet, wherein the flow control device is configured to preclude flow to the first spray arrangement and permit flow to the second spray arrangement in response to the circulation pump pumping washing liquid from the sump to the washing liquid storage tank, and wherein flow from the circulation pump through the first outlet and the second outlet is unimpeded at all times.

2. The dishwasher according to claim 1, wherein the hydraulic arrangement further comprises a first conduit wherein the second outlet is connected to the washing liquid storage tank via the first conduit wherein said first conduit is provided with a flow regulating valve having at least an open state and a closed state.

3. The dishwasher according to claim 2, wherein washing liquid in the washing liquid storage tank is arranged to be evacuated from the washing liquid storage tank to the sump via the circulation pump in a direction from the second outlet to the inlet of the circulation pump, when a motion of the circulation pump is stopped and the flow regulating valve is in the open state.

4. The dishwasher according to claim 3, wherein the washing liquid storage tank is arranged at a position such that washing liquid stored in the washing liquid storage tank is stored at a higher location than washing liquid in the sump, and where washing liquid in the washing liquid storage tank is arranged to be evacuated from the washing liquid storage tank to the sump by the force of gravity.

5. The dishwasher according to claim 2, wherein the hydraulic arrangement further comprises an actuator arranged to control the flow regulating valve between the open state and the closed state.

6. The dishwasher according to claim 1, wherein the washing liquid storage tank is arranged to store washing liquid for subsequent use.

7. A dishwasher comprising a washing chamber with a sump and a hydraulic arrangement comprising;

the sump, a circulation pump having a first inlet, a first outlet, and a second outlet, first and second spray arrangements, a flow controller disposed between the first outlet and the first and second spray arrangements and configured to control flow between the first outlet and the first and second spray arrangements independently, a washing liquid storage tank, a first conduit disposed between the first outlet and the flow controller, and a second conduit disposed between the second outlet and the washing liquid storage tank;

wherein the circulation pump is arranged to pump washing liquid from the sump to the first and second spray arrangements through the first outlet and through the first conduit and the flow control device, wherein the circulation pump is arranged to pump washing liquid from the sump to the washing liquid storage tank through the second outlet and through the second conduit, wherein in response to a command to fill the washing liquid storage tank, the fluid flow controller precludes flow to the first spray arrangement and permits flow to the second spray arrangement.

8. The dishwasher according to claim 7, wherein the first spray arrangement is disposed at a first position at a first height above the sump, wherein the second spray arrangement is disposed at a second position at a second height above the sump, wherein the second height is greater than the first height.

* * * * *